US008339044B2

(12) United States Patent
Panyik et al.

(10) Patent No.: US 8,339,044 B2
(45) Date of Patent: Dec. 25, 2012

(54) MERCURY-FREE CERAMIC METAL HALIDE LAMP WITH IMPROVED LUMEN RUN-UP

(75) Inventors: Tamás Panyik, Budapest (HU); István Csányi, Dunakeszi (HU); József Gábeli, Szodliget (HU); István Maros, Budapest (HU)

(73) Assignee: General Electric Company, Schenectady, NY (US)

( * ) Notice: Subject to any disclaimer, the term of this patent is extended or adjusted under 35 U.S.C. 154(b) by 14 days.

(21) Appl. No.: 12/980,012

(22) Filed: Dec. 28, 2010

(65) Prior Publication Data

US 2012/0161623 A1 Jun. 28, 2012

(51) Int. Cl.

| | |
|---|---|
| ***H01J 17/20*** | (2006.01) |
| ***H01J 7/12*** | (2006.01) |
| ***H01J 7/08*** | (2006.01) |
| ***H01J 61/22*** | (2006.01) |

(52) U.S. Cl. ..... 313/640; 313/637; 313/642

(58) Field of Classification Search ..... 313/631–643
See application file for complete search history.

(56) References Cited

U.S. PATENT DOCUMENTS

| | | | | |
|---|---|---|---|---|
| 5,866,982 | A | 2/1999 | Scott et al. | |
| 6,346,495 | B1 | 2/2002 | Dynys et al. | |
| 6,525,454 | B2 | 2/2003 | Calon et al. | |
| 6,555,971 | B1 | 4/2003 | Lestician | |
| 6,600,256 | B2 | 7/2003 | Van Lier et al. | |
| 6,661,176 | B2 | 12/2003 | Honda et al. | |
| 6,791,281 | B2 | 9/2004 | Mita | |
| 6,891,336 | B1 | 5/2005 | Mita | |
| 7,138,766 | B2 * | 11/2006 | Takeuchi et al. | 313/643 |
| 7,141,932 | B2 * | 11/2006 | Deguchi et al. | 313/638 |
| 7,215,081 | B2 | 5/2007 | Bewlay et al. | |
| 7,245,075 | B2 | 7/2007 | Chen et al. | |
| 7,268,495 | B2 * | 9/2007 | Rintamaki et al. | 313/640 |
| 2002/0017848 | A1 | 2/2002 | Minamihata et al. | |
| 2002/0135304 | A1 | 9/2002 | Honda et al. | |
| 2002/0163315 | A1 | 11/2002 | Kaneko et al. | |
| 2003/0062831 | A1 | 4/2003 | Alderman et al. | |

(Continued)

FOREIGN PATENT DOCUMENTS

| | | |
|---|---|---|
| EP | 1550147 B1 | 2/2007 |

(Continued)

OTHER PUBLICATIONS

PCT Search Report and Written Opinion dated Apr. 24, 2012 from corresponding Application No. PCT/US2011/059490.

(Continued)

*Primary Examiner* — Mariceli Santiago
(74) *Attorney, Agent, or Firm* — GE Global Patent Operation; Peter T. DiMauro

(57) ABSTRACT

Disclosed herein are mercury free ceramic metal halide high intensity discharge lamps of specified arc tube geometry and composition of ionizable fill. Embodiments herein generally employ a discharge vessel formed of a ceramic material having an aspect ratio satisfied by 1<ITL/ID<4.5 where ITL is the inner total length of the discharge vessel and ID is the inner diameter of the discharge vessel. The ionizable fill typically comprises xenon at a cold fill pressure of from about 3 to about 15 bar, and a halide component comprising sodium halide, thallium halide and/or indium halide, and at least one rare earth halide. Disclosed advantages may include betterment in both lumen run-up and color shift upon dimming, as compared to mercury-containing CMH HID lamps.

20 Claims, 2 Drawing Sheets

U.S. PATENT DOCUMENTS

| | | | | |
|---|---|---|---|---|
| 2006/0087251 | A1 | 4/2006 | Hirschmann et al. | |
| 2006/0108927 | A1 | 5/2006 | Gunther et al. | |
| 2006/0164016 | A1 | 7/2006 | Rintamaki et al. | |
| 2006/0164017 | A1 | 7/2006 | Rintamaki et al. | |
| 2006/0226776 | A1* | 10/2006 | Chen et al. | 313/568 |
| 2006/0290285 | A1 | 12/2006 | Lapatovich et al. | |
| 2007/0085478 | A1 | 4/2007 | Dakin et al. | |
| 2007/0120458 | A1 | 5/2007 | Rahmane et al. | |
| 2007/0120492 | A1 | 5/2007 | Selezneva et al. | |
| 2008/0001543 | A1* | 1/2008 | Kashiwagi et al. | 313/638 |
| 2008/0018254 | A1 | 1/2008 | Rahmane et al. | |
| 2008/0157675 | A1 | 7/2008 | Gunther et al. | |
| 2008/0278077 | A1 | 11/2008 | Geijtenbeek et al. | |
| 2009/0146576 | A1* | 6/2009 | Russell et al. | 313/640 |
| 2009/0295287 | A1 | 12/2009 | Tsuda et al. | |
| 2010/0033106 | A1 | 2/2010 | Ishida et al. | |
| 2010/0052531 | A1 | 3/2010 | Stappers et al. | |
| 2010/0079070 | A1 | 4/2010 | Browne et al. | |
| 2010/0141138 | A1 | 6/2010 | Haacke et al. | |

FOREIGN PATENT DOCUMENTS

| | | | |
|---|---|---|---|
| EP | 1755145 | A2 | 2/2007 |
| EP | 1755148 | A2 | 2/2007 |
| EP | 1806766 | A1 | 7/2007 |
| EP | 1903598 | A2 | 3/2008 |
| JP | 2005032448 | A | 2/2005 |
| JP | 2009259769 | A | 11/2009 |
| JP | 2010140826 | | 6/2010 |
| WO | 2007063444 | A1 | 6/2007 |
| WO | 2007064622 | A1 | 6/2007 |
| WO | 2010097732 | | 9/2010 |

OTHER PUBLICATIONS

PCT Invitation to Pay Additional Fees dated Feb. 27, 2012 from corresponding Application No. PCT/US2011/059490.

* cited by examiner

MERCURY-FREE CERAMIC METAL HALIDE LAMP WITH IMPROVED LUMEN RUN-UP

FIELD OF THE INVENTION

The present invention generally relates to ceramic arc discharge lamps, and more particular, relates to mercury-free ceramic metal halide high intensity discharge lamps.

BACKGROUND

Discharge lamps produce light by ionizing a vapor fill material, such as a mixture of rare gases, metal halides and mercury with an electric arc passing between two electrodes. The electrodes and the fill material are sealed within a translucent or transparent discharge vessel that maintains the pressure of the energized fill material and allows the emitted light to pass through it. The ionizable fill material, also known as a "dose," emits a desired spectral energy distribution in response to being excited by the electric arc. For example, halides provide spectral energy distributions that offer a broad choice of light properties, e.g. color temperatures, color renderings, and luminous efficacies.

High Intensity Discharge (HID) lamps are high-efficiency lamps that can generate large amounts of light from a relatively small source. These lamps are widely used in many applications, including highway and road lighting, lighting of large venues such as sports stadiums, floodlighting of buildings, shops, industrial buildings, and projectors, to name but a few. The term "HID lamp" is used to denote different kinds of lamps. These include mercury vapor lamps, metal halide lamps, and sodium lamps. HID lamps differ from other lamps because their functioning environment requires operation at high temperature and high pressure over a prolonged period of time. Ceramic discharge chambers for HID lamps have been developed to operate at higher temperatures for improved color temperatures, color renderings, and luminous efficacies, while significantly reducing reactions with the fill material. Such lamps with ceramic discharge chambers have been termed "CMH HID" lamps. Metal halide (e.g., CMH) lamps are widely used because they have a higher efficiency than incandescent lamps. This is economically and environmentally beneficial.

Commercially, though, many metal halide lamps contain mercury in their fill. The mercury content in the lamp fill generally does contributes to lamp performance. However, mercury has been considered an environmentally undesirable material. Yet, the problem of replacement or reduction of the mercury content in metal halide lamps is not trivial, since mercury performs so many functions in a metal halide lamp. In general, each function of Hg must be performed by any replacement material (or combination of replacement materials). For example, the mercury functions as (1) a voltage generator, (2) buffer gas, and (3) as a means of reducing $I_2$ formation (for iodide-based lamps). Therefore, in replacing or reducing the amount of mercury, it is necessary to address the problems which arise with regard to these functions of mercury within the metal halide lamp.

Therefore, there is a need for energy-efficient lighting systems which do not contain undesirable amounts of mercury.

BRIEF SUMMARY

One embodiment of the present invention is directed to mercury-free high intensity discharge lamp comprising a discharge vessel formed of a ceramic material and defining an interior space. An aspect ratio of the discharge vessel is satisfied by $1<ITL/ID<4.5$ where ITL is the inner total length of the discharge vessel and ID is the inner diameter of the discharge vessel. At least one electrode extends into the discharge vessel. A mercury-free ionizable fill is disposed within the interior space and sealed within the vessel, wherein the fill is free of elemental mercury and mercury compounds. The ionizable fill includes (a) an inert gas sealed within said vessel, the inert gas comprising at least about 95% Xe, the inert gas present at a cold fill pressure of from about 3 to about 15 bar; and (b) a halide component, the halide component comprising: (i) sodium halide; (ii) thallium halide and/or indium halide; and (iii) at least one rare earth halide.

A further embodiment of the present invention is directed to a mercury-free CMH lamp, comprising a substantially cylindrical discharge vessel formed of a ceramic material. The vessel define an interior space. An aspect ratio of the discharge vessel is satisfied by $1.5<ITL/ID<3$, where ITL is the inner total length of the discharge vessel and ID is the inner diameter of the discharge vessel. The ITL of the discharge vessel is at least about 7.5 mm, and a ratio of wall thickness (WT) to ID of the discharge vessel is less than about 0.15. At least one tungsten electrode extends into the discharge vessel. A mercury-free ionizable fill is disposed within the interior space and is sealed within the vessel, wherein the fill is free of elemental mercury and mercury compounds. The fill includes an inert gas sealed within said vessel, the inert gas consisting of Xe, present at a cold fill pressure of from greater than 5 bar to about 15 bar. The fill further includes a halide component, the halide component comprising $DyI_3$, $HoI_3$, $TmI_3$, $CeI_3$, NaI, TlI, InI, $CaI_2$ and optionally $ZnI_2$. The ionizable fill is free of elemental zinc and is free of all rare earths other than dysprosium, holmium, thulium, and cerium. The fill further comprises an oxide or oxyhalide of tungsten.

Other features and advantages of this invention will be better appreciated from the following detailed description.

BRIEF DESCRIPTION OF THE DRAWINGS

Embodiments of the invention will now be described in greater detail with reference to the accompanying Figures.

DETAILED DESCRIPTION

Figure 1:
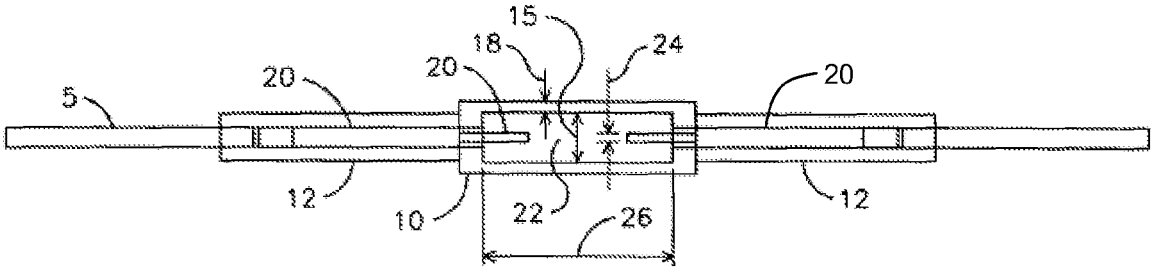
FIG. 1 is an exemplary embodiment of a schematic of a CMH HID lamp of the present invention.

The present applicants have realized a ceramic HID light source which does not employ Hg, through judicious selection of the dose composition (fill) in combination with arc-tube geometry. Embodiments of this invention have employed a design which has as its aim to maintain lamp parameters at least as high as for conventional Hg containing lamps (i.e., all major photometrical parameters are typically the same as for a Hg containing CMH HID lamp). In addition, the combination of dose composition and arc geometry has resulted in a synergic effect, whereby improved color shift during dimming and improved lumen run-up characteristics are generally attained.

In accordance with embodiments, the present invention generally relates to a mercury-free high intensity discharge lamp, where the lamp comprises a discharge vessel formed of a ceramic material. According to embodiments of the present disclosure, the discharge vessel (e.g., arc tube) may be made of polycrystalline alumina (i.e. PCA). The use of PCA allows the lamp to run at higher temperatures than a quartz lamp without suffering devitrification. Other ceramic materials which may be used include non reactive refractory oxides and oxynitrides such as sapphire, yttrium oxide, lutetium oxide, aluminum nitride, spinel, and hafnium oxide and their solid solutions and compounds with alumina such as yttrium-aluminum-garnet (YAG) and aluminum oxynitride. Other ceramic materials are contemplated to be within the scope of the disclosure and it should not be construed as limited only to those named.

A typical ceramic discharge lamp according to this disclosure includes an elongated ceramic discharge vessel containing a dose or a fill of an ionizable material. This discharge vessel has a central portion which defines an interior space, the central portion having a longer axis and a shorter axis. Within the discharge vessel can generally be positioned at least one (usually at least two) electrodes so as to energize the dose when an electric current is applied thereto. For vessels with a generally cylindrically shaped central portion, the central portion includes a substantially cylindrical wall and two spaced end walls connected at both ends of the cylindrical wall, the end walls lying generally perpendicular to the longer axis. (The central part of the arc tube is preferentially cylindrical geometry but may also be elliptical, spherical, or intermediate shapes). Vessels according to this disclosure may also include at least two end portions or "legs", extending from the two spaced end walls, and these leg portions each support at least one electrode at least partially therein. A ceramic metal halide arc tube can be of a three part construction, and may be formed, for example, as described, for example, in any one of U.S. Pat. Nos. 5,866,982; 6,346,495; 7,215,081; and U.S. Pub. Nos. 2006/0164017; 2007/0120458, 2006/0164016, and 2007/0120492, all of which are hereby incorporated by reference. It will be appreciated that the arc tube, can be constructed from fewer or greater number of components, such as one or five components.

The discharge vessel may include a body which is substantially cylindrical. In certain embodiments, the discharge vessel includes a body portion having an internal total length (ITL), parallel to a central axis of the discharge vessel and an internal diameter, perpendicular to the internal length.

The discharge vessel is defined by an aspect ratio, which ratio is satisfied by the following: $1<ITL/ID<4.5$, where ITL is the inner total length of the discharge vessel and ID is the inner diameter of the discharge vessel. In certain embodiments, the aspect ratio of the discharge vessel is satisfied by $1.5 \leqq ITL/ID \leqq 3$. In some embodiments, the ID is at least about 2 mm. In some embodiments, the inner total length (ITL) of the discharge vessel is at least about 4 mm, preferably at least about 7.5 mm, more preferably at least about 8 mm. Furthermore, embodiments of the invention contemplate a ratio of wall thickness (WT) to inner diameter (ID) of the discharge vessel being less than about 0.15.

It is contemplated to be within the scope of the invention to choose some or many of these geometric conditions simultaneously. Therefore, for example, there exists an embodiment of the invention where the aspect ratio of the discharge vessel is satisfied by $1.5 \leqq ITL/ID \leqq 3$, and the ratio of wall thickness (WT) to inner diameter (ID) of the discharge vessel being less than about 0.15, and the ITl, is at least about 8 mm (e.g., 10-20 mm). Other combinations of geometric parameters are possible and intended to be within the scope of this disclosure.

The interior space of a discharge vessel may have different values for volume. Generally, an interior space will have a volume commensurate with the operating voltage of the lamp as well as sustainable wall loading. As used herein, "Arctube Wall Loading" (WL) is the arctube power (watts) divided by the arctube surface area (square cm), as would be understood by persons having ordinary skill in the art. For purposes of calculating WL, the surface area is the total internal surface area, and the arctube power is the total arctube power including electrode power. For example, for a 50 W lamp, the volume may be from about 0.125 $cm^3$ to about 0.17 $cm^3$, e.g., about 0.15 $cm^3$. For a 70 W lamp, the volume may be (for example) from about 0.16 $cm^3$ to about 0.26 $cm^3$, e.g., about 0.20 $cm^3$. For a 100 W lamp, the volume may be (for example) from about 0.26 $cm^3$ to about 0.54 $cm^3$, e.g., about 0.40 $cm^3$. For a 150 W lamp, the volume may be (for example) from about 0.5 $cm^3$ to about 0.9 $cm^3$, e.g., about 0.7 $cm^3$. Higher powered lamps may have even larger volumes of interior space. Other volumes are possible.

As noted, at least one electrode extends into the discharge vessel. Standard electrode materials may be used such as niobium wire, molybdenum wire, tungsten wire, and combinations and alloys thereof. Tungsten is most common. It may be necessary, if one desires to use molybdenum as a wire material, to coat the molybdenum with tungsten. An alternative to these electrode materials is cermet (ceramic metal) materials which are known for use as electrodes. The at least one electrode is configured within the discharge vessel to energize the ionizable fill when an electric current is applied thereto.

A mercury-free ionizable fill is sealed within the vessel, wherein the fill is free of elemental mercury and mercury compounds. As used herein, "free" generally means that an element is present (in either elemental or compound form) in no greater than normal impurity amounts as part of the discharge vessel, electrodes, and/or other components of the fill.

The ionizable fill includes, among other components, an inert gas sealed within the vessel, the inert gas comprising at least about 95 mol % Xe. The xenon component of the ionizable fill, present at the high pressures of this disclosure, tends to protect the luminance of the lamp when operated at such high pressures, as compared to other inert gases. Of course, up to about 5 mol % of one of Ar, Ne and Kr may be present in the inert gas component of the fill; but preferably the inert gas component of the fill is substantially completely Xe. Radioactive gases (e.g., radioactive inert gases such as Kr-85) are not added to the fill. Importantly, there are also no other radioactive materials are in the fill (e.g., thorium or thorium halide).

Importantly, the inert gas is present in the vessel at a cold fill pressure of from about 3 to about 15 bar. In some embodiments, the inert gas is present at a cold fill pressure of from greater than 5 bar, or up to about 15 bar. For example, the inert gas may be present at a cold fill pressure of from 5 to 15 bar (e.g. about 12 to about 15 bar, e.g., 12 bar).

The ionizable fill also comprises a halide component. The term "halide component" is a collective term referring to all metal halide compounds in the fill. The halide component comprises: (i) sodium halide; (ii) at least one of thallium halide and indium halide; and (iii) at least one rare earth halide. The halide component may also optionally comprise an alkaline earth metal halide (e.g., calcium halide), and may also optionally comprise zinc halide (e.g., zinc iodide), and may also optionally comprise a tungsten oxyhalide. However, the fill is free of elemental zinc (i.e., zinc in atomic form).

The halide(s) in the halide component can each be selected from chlorides, bromides, iodides and combinations thereof. In one embodiment, the halides are all iodides. Iodides tend to provide longer lamp life, as corrosion of the arc tube and/or electrodes is lower with iodide components in the fill than with otherwise similar chloride or bromide components.

In some embodiments, the sodium halide is present in the fill in a molar fraction of the total halide component of from about 0.1 to about 0.6, or more narrowly of from about 0.35 to about 0.45. The "total halide component" is the total number of moles of halide compounds in the fill. In another embodiment, the molar ratio of the sodium halide to total rare earth halides in the fill is from 0.5 to 3. In general, there may be anywhere from 5 to 50 μmol of sodium halide in the fill. The inclusion of Na is chosen at least in part for its contribution to high luminosity (i.e., lumens).

Where present, the ionizable fill may comprise indium halide in an amount of from 0.2 to 20 μmol. Where present, the ionizable fill may comprise thallium halide in an amount of from 0.8 to 10 μmol. The inclusion of Tl and/or In is chosen at least in part for their contribution to high luminosity (i.e., lumens).

In one embodiment, the at least one rare earth halide is selected from the group consisting of dysprosium halide, holmium halide, thulium halide, cerium halide, and combinations thereof. In accordance with embodiments of the invention, the ionizable fill is free of Sc and Pr in elemental or compound form. Scandium and praseodymium are not present in the fill since they are considered as being chemically aggressive; they can contribute to leaks in the vessel envelope. In view of a desire for a highly reliable CMH lamp, Sc and Pr should be absent from the fill. In another embodiment, the ionizable fill is free of all rare earths other than dysprosium, holmium, thulium, and cerium. In yet another embodiment, the rare earth halide component may comprises a combination of dysprosium halide, holmium halide, thulium halide, and cerium halide. Where all of Dy, Ho, Tm, and Ce are present in the fill, the fill may contain 0.8 to 10 μmol of Dy halide; 0.7 to 70 μmol of Ho halide; 0.7 to 70 μmol of Tm halide; and 0.4 to 40 μmol of Ce halide.

Many of the possible rare earth element halide components of the ionizable fill are chosen for distinct advantages. In particular, when present, halides of Dy, Ho, and Tm generally provide a more full spectral output, which leads to high color rendering. Higher levels of Dy, Ho and Tm may promote higher values for Ra, the standard color rendering index (CRI).

As noted, the halide component may optionally comprise an alkaline earth metal halide, preferably calcium halide. Where present, the calcium halide may be present in the fill in an amount of from 5 to 50 μmol. In another embodiment, calcium halide is present in the fill in a molar fraction of the total halide component of from about 0.1 to about 0.6 (or more narrowly, of from about 0.3 to about 0.4). Halides of Ca may also contribute to a full/broad spectrum.

In some embodiments, the ionizable fill may comprise an oxide of tungsten, which may be a binary compound of tungsten and oxygen, or which may be originally provided as an oxyhalide of tungsten, or become an oxyhalide through reaction with halide components of the fill. The oxide and/or oxyhalide of tungsten disclosed here functions to provide available oxygen which in a form that is capable of taking part in the "wall cleaning cycle" at the operating temperature of the lamp. One possible problem with CMH HID lamps (in general) is that the light output over time (typically expressed as lumen maintenance) may tend to diminish due to blackening of the walls of the discharge vessel. The blackening is due to electrode material (e.g, tungsten) transported from the electrode to the wall. The available oxygen provided by the oxide and/or oxyhalide of tungsten aids in the wall cleaning cycle and thus can improve lumen maintenance over the lifetime of the lamp. By "oxide of tungsten", it is meant any oxidized form of tungsten or combination thereof which includes at least one tungsten oxygen bond. Examples of oxides of tungsten include oxides and oxyhalides of tungsten and reactants/compounds which react or decompose in the lamp under lamp operating conditions to form tungsten oxide or oxyhalide. In one embodiment, the oxide of tungsten may have the general formula $WO_nX_m$, where n is at least I, m can be ≧0, and X is a halide as defined above. Exemplary oxides of tungsten include $WO_3$, $WO_2$, and tungsten oxyhalides, such as $WO_2I_2$, and combinations thereof. The fill may comprise of from 0.1 to 40 micromoles of W in any of these forms.

Embodiments of the invention contemplate an ionizable fill which comprise all of the noted components in the Table 1, present in the following amounts in the discharge vessel:

TABLE I

| fill component | micromoles of fill component |
|---|---|
| $DyI_3$ | 0.8 to 10 |
| $HoI_3$ | 0.7 to 70 |
| $TmI_3$ | 0.7 to 70 |
| $CeI_3$ | 0.4 to 40 |
| NaI | 5 to 50 |
| TlI | 0.8 to 10 |
| InI | 0.2 to 20 |
| $CaI_2$ | 5 to 50 |
| $WO_3 + WO_2I_2$ | 0.1 to 40 |

The person of ordinary skill in the field may calculate concentration of fill components (micromol/$cm^3$) by taking into account the values above and the different values for volume of interior space of the discharge vessel, noted above. Higher numbers of micromoles are generally used for larger vessels.

Typically, lamps according to embodiments of the invention have a nominal power (or power rating) in the range of from about 20 to about 400 W. As used herein, the term "rated power", "nominal lamp power" and "lamp power rating", or any version thereof, which may be used interchangeably herein, refers to the optimum wattage at which the lamp is intended to be operated, in accord with industry standards. Generally, a lamp according to embodiments of the invention is part of a lighting assembly which also comprises a ballast, e.g., electronic ballast. In some embodiments, lamps according to the invention operate at an arc tube wall loading of from about 20 to about 40 W/$cm^2$, for example, about 35 W/$cm^2$. Higher values are also possible.

FIG. 1 is an exemplary embodiment of a schematic of a CMH lamp. As illustrated, the ceramic HID lamp 5 has a straight cylindrical arc-tube body 10, also referred to as an envelope or vessel. The vessel defines an interior space 22, in which the ionizable fill (not shown) is disposed. The central part of the arc tube is preferentially cylindrical geometry but may also be elliptical, spherical, or intermediate shapes. Cylindrical ceramic legs 12 are located at opposite ends of the arc-tube body 10. Within the HID lamp 5, a metal electrode 20, typically made from tungsten, is inserted and sealed inside each leg 12 and extends into the arc-tube body 10; the portion of electrode 20 within the interior space 22 may have varying shank diameter 24. The arc-tube body 10 has an inner diameter (ID) denoted as item 15, and a wall thickness (WI) denoted as item 18. Item 26 is representative of the inner total length (ITL).

The electrodes are typically fed with an alternating electric current via conductors (e.g., from a ballast, not shown). The exemplary arc tube may be surrounded by an outer bulb that is provided with a lamp cap at one end, through which the lamp is connected with a source of power (not shown). This outer bulb may be formed of glass or other suitable material.

A ballast acts as a starter when the lamp is switched on. The ballast is located in a circuit that includes the lamp and the power source.

Embodiments of the present invention include lamps which provide light which typically appears to be white, and having a CCT of from about 3000 K to about 4000 K. Correlated color temperature (CCT) is defined as the absolute temperature, expressed in degrees Kelvin (K), of a black body radiator when the chromaticity (color) of the black body radiator most closely matches that of the light source. CCT may be estimated from the position of the chromatic coordinates in the Commission Internationale de l'Eclairage (CIE) 1960 color space. From this standpoint, the CCT rating is an indication of how "warm" or "cool" the light source is. The higher the number, the cooler the lamp. The lower the number, the warmer the lamp. Embodiments of the present invention include lamps which may provide light having an Ra value of above 70, preferably about 80, according to the standard color rendering index (CRI).

In general, some prior art CMH lamps have a drawback when operated at less than full power rating. As the operating lamp power level is reduced, the color of emitted light may shift, e.g., from white to green. This is exhibited by an increase in the correlated color temperature (CCT) of the lamp by as much as 1000 K or more. CMH lamp color is primarily decided by the halide dose composition in the vapor phase in the arc tube. When the CMH lamp is dimmed, the halide vapor pressure in the arc will drop with the reduction of arc tube temperature. Such a shift in light color has a considerable impact on commercial usage. For example, retail and display venues, which often employ CMH lamps due to their long life and focused light emissions, can suffer considerably from lighting that does not present items being displayed to their best advantage, i.e., under white light. The same is true for public venues where lighting contributes to the atmosphere or ambiance experienced by customers. Lamps according to embodiments of the invention when operated at 25% nominal lamp power, generally exhibit a CCT of within +/−600 K of the CCT of the lamp when operated at 50% nominal lamp power.

The property of the lamp that is referred to herein as the "lumen run-up" refers to the period of time that it takes the lamp to reach a given percentage of its stabilized lumen output after the lamp is turned on. Lumens (lm), as used herein, refer to the SI unit of luminous flux, a measure of the perceived power of light. The lumen can be considered as a measure of the total "amount" of visible light emitted. Certain embodiments of the invention may achieve 50% of stabilized lumen output in about 50 sec or less after the lamp is turned on. Certain embodiments of the invention may achieve 80% of stabilized lumen output in about 90 sec or less after the lamp is turned on.

In order to promote a further understanding of the invention, the following examples are provided. These examples are illustrative, and should not be construed to be any sort of limitation on the scope of the claimed invention.

EXAMPLES

Example 1

An exemplary CMH HID lamp was constructed using a PCA-Y discharge vessel having an arc geometry in accordance with the present disclosure. That is, the ITl. was 7.5 mm; ratio of inner total length/inner diameter (ITL/ID) was within 1.5-3; ID was at least 2 mm; and ratio of WT/ID was less than or equal to 0.15. The inert gas was Xe present at 12 bar cold fill pressure. The following was the composition of the remaining fill components of the ionizable

| fill component | weight ratio | mass (mg) |
|---|---|---|
| $DyI_3$ | 0.0994 | 0.48720 |
| $HoI_3$ | 0.1003 | 0.49140 |
| $TmI_3$ | 0.1011 | 0.49560 |
| $CeI_3$ | 0.0612 | 0.30000 |
| NaI | 0.2042 | 1.00102 |
| TlI | 0.0608 | 0.29778 |
| $CaI_2$ | 0.3731 | −1.82868 |

The lamp, when operated on 58.8 V and 40.2 W and a wall loading of 36.3 W/cm$^2$, exhibited the following photometric parameters: chromaticity coordinate (0.422, 0.399); CCT=3227 K; Ra=81; efficacy=82.9 lm/W.

Example 2

Figure 2:
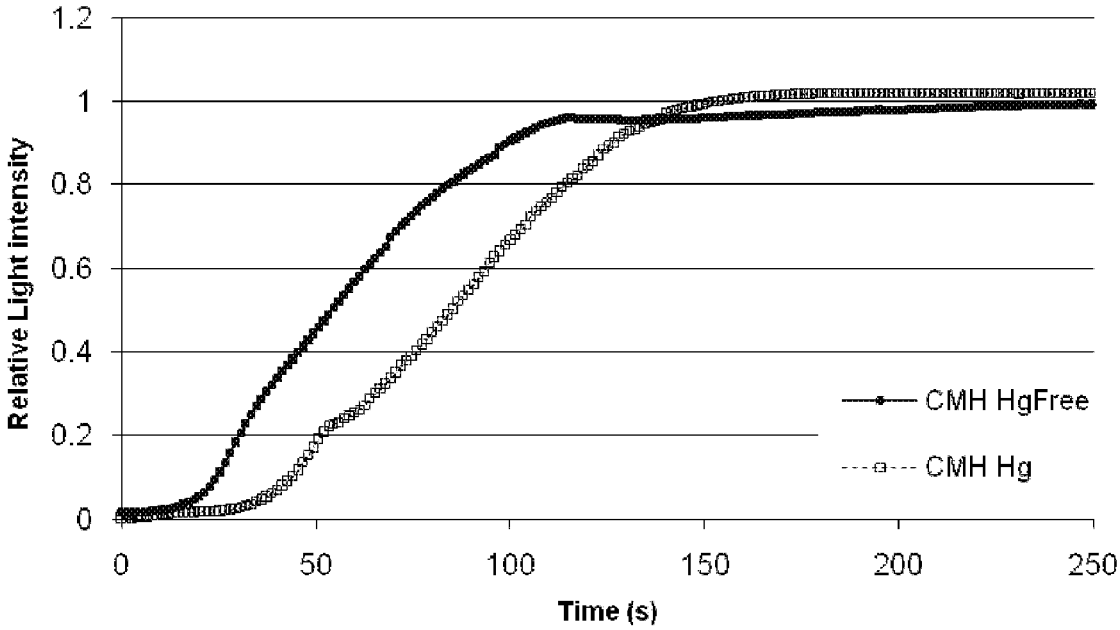
FIG. 2 is a plot of lumen run-up of a lamp in accordance with embodiments of the invention, vs. a control.
Figure 3:
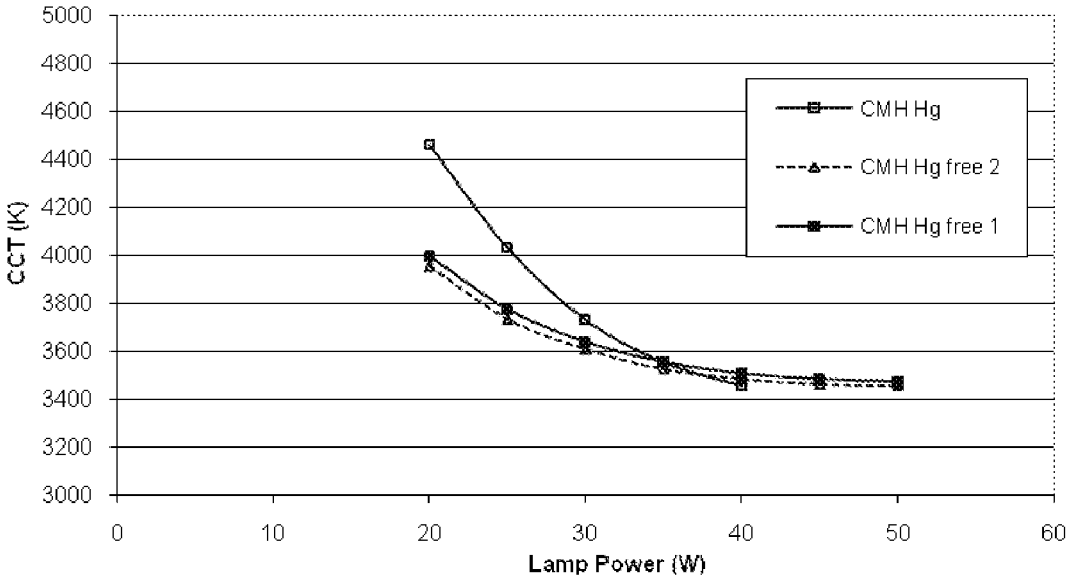
FIG. 3 is a plot of color shift as a function of lamp power for a lamp in accordance with embodiments of the invention, vs. a control.

In FIG. 2 and FIG. 3, two comparative tests were performed between the exemplary lamp of Example 1, and a standard mercury containing CMH HID lamp. The standard comparative lamp was a mercury-containing, 35 W, nominal 3000 K CCT, commercial G12 finished CMH HID lamp. The exemplary lamp of Example 1 was first aged over 1000 h to provide an aged exemplary lamp. FIG. 2 shows a plot of the lumen run-up of this aged lamp compared to the standard Hg-containing CMH lamp. The exemplary lamp displayed a faster run up to 50% of steady-state light intensity vs. the standard, and a faster run up to 80% of steady-state light intensity vs. the standard. FIG. 3 depicts a plot of the color shift which occurs with the lamp when operated in the range of from 20% to 50% of rated lamp power. The plot is of the color temperature (CCT) in K, vs. relative lamp power. For the exemplary aged lamp, two runs were performed, and both showed only a relatively small increase in CCT upon dimming from 50% rated power to 20% rated power: lamps according to embodiments of the invention when operated at 25% nominal lamp power, exhibit a CCT of within +/−600 K of the CCT of the lamp when operated at 50% nominal lamp power. In contrast, the standard Hg-containing lamp shifted from about 3420 K at 40% rated power, to about 4450 K at 20% rated power, an increase of over 1000 K. Thus, the exemplary lamps showed betterment in both lumen run-up and color shift upon dimming.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" used in connection with a quantity is inclusive of the stated value and has the meaning dictated by the context (for example, includes the degree of error associated with the measurement of the particular quantity). "Optional" or "optionally" means that the subsequently described event or circumstance may or may not occur, or that the subsequently identified material may or may not be present, and that the description includes instances where the event or circumstance occurs or where the material is present, and instances where the event or circumstance does not occur or the material is not present. The singular forms "a", "an" and "the" include plural referents unless the context clearly dictates otherwise. All ranges disclosed herein are inclusive of the recited endpoint and independently combinable.

As used herein, the phrases "adapted to," "configured to," and the like refer to elements that are sized, arranged or manufactured to form a specified structure or to achieve a specified result. While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims. It is also anticipated that advances in science and technology will make equivalents and substitutions possible that are not now contemplated by reason of the imprecision of language and these variations should also be construed where possible to be covered by the appended claims.

What is claimed as new and desired to be protected by Letters Patent of the United States is:

1. A mercury-free high intensity discharge lamp comprising:

a discharge vessel formed of a ceramic material and defining an interior space, wherein an aspect ratio of the discharge vessel is satisfied by 1<ITL/ID<4.5 where ITL is the inner total length of the discharge vessel and ID is the inner diameter of the discharge vessel;

at least one electrode extending into the discharge vessel; and a mercury-free and scandium-free ionizable fill disposed within the interior space and sealed within the vessel, wherein said fill is free of elemental mercury and mercury compounds, and wherein the ionizable fill is further free of elemental zinc, said fill including:

(a) an inert gas sealed within said vessel, said inert gas comprising at least about 95% Xe, said inert gas present at a cold fill pressure of from about 3 to about 15 bar; and (b) a halide component, said halide component comprising:

(i) sodium halide;

(ii) thallium halide; and (iii) at least one rare earth halide, wherein the at least one rare earth halide comprises holmium halide.

2. The lamp in accordance with claim 1, wherein the sodium halide is present in the ionizable fill in a molar fraction of the total halide component of from about 0.1 to about 0.6.

3. The lamp in accordance with claim 1, wherein a molar ratio of the sodium halide to total rare earth halides in the fill is from about 0.5 to about 3.

4. The lamp in accordance with claim 1, wherein the ionizable fill further comprises an oxide or oxide halide of tungsten.

5. The lamp in accordance with claim 1, wherein the at least one rare earth halide is selected from the group consisting of dysprosium halide, holmium halide, thulium halide, cerium halide, and combinations thereof.

6. The lamp in accordance with claim 5, wherein the at least one rare earth halide comprises a combination of dysprosium halide, holmium halide, thulium halide, and cerium halide.

7. The lamp in accordance with claim 1, wherein the halide component further comprises calcium halide.

8. The lamp in accordance with claim 1, wherein ionizable fill further comprises zinc halide.

9. The lamp in accordance with claim 1, wherein said inert gas consists essentially of Xe.

10. The lamp in accordance with claim 1, wherein the ionizable fill is free of al earths other than dysprosium, holmium, thulium, and cerium.

11. The lamp in accordance with claim 1, wherein the halide component is selected from iodides.

12. The lamp in accordance with claim 1, wherein an aspect ratio of the discharge vessel is satisfied by 1.5 ≦ITL/ID ≦3.

13. The lamp in accordance with claim 1, wherein a ratio of wall thickness (WI) to inner diameter (ID) of the discharge vessel is less than about 0.15 .

14. The lamp in accordance with claim 1, wherein the inner total length (ITL) of the discharge vessel is at least about 7.5 mm.

15. The lamp in accordance with claim wherein the lamp has a nominal power in the range of from about 20 to about 400 W.

16. The lamp in accordance with claim 1, wherein the lamp, when operated at 25% nominal lamp power, exhibits a CCT of within +/−600 K of the CCT of the lamp when operated at 50% nominal lamp power.

17. A mercury-free CMh lamp, comprising:

a substantially cylindrical discharge vessel formed of a ceramic material and defining an interior space, wherein an aspect ratio of the discharge vessel is satisfied by 1.5≦ITL/ID≦3, where ITL is the inner total length of the discharge vessel and ID is the inner diameter of the discharge vessel, wherein the ITL of the discharge vessel is at least about 7.5 mm, wherein a ratio of wall thickness (WT) to ID of the discharge vessel is less than about 0.15;

at least one tungsten electrode extending into the discharge vessel; and a mercury-free ionizable fill disposed within the interior space and sealed within the vessel, wherein said fill is free of elemental mercury and mercury compounds, said fill including:

(a) an inert gas sealed within said vessel, said inert gas consisting of Xe, said inert gas present at a cold fill pressure of from greater than 5 bar to about 15 bar;

(b) a halide component, said halide component comprising $DyI_3$, $HoI_3$, $TmI_3$, $CeI_3$, NaI, T1I, InI, $CaI_2$ and optionally $ZnI_2$; wherein the ionizable fill is free of elemental zinc and is free of all rare earths other than dysprosium, holmium, thulium, and cerium; and (c) the ionizable fill further comprising an oxide or oxyhalide of tungsten.

18. The lamp in accordance with claim 17, wherein the ITL of the discharge vessel is greater than 8 mm.

19. The lamp in accordance with claim 1, wherein the ionizable fill comprises the following components present in the following amounts in the discharge vessel:

| fill component | micromoles of fill component |
|---|---|
| $DyI_3$ | 0.8 to 10 |
| $HoI_3$ | 0.7 to 70 |
| $TmI_3$ | 0.7 to 70 |
| $CeI_3$ | 0.4 to 40 |
| NaI | 5 to 50 |
| TlI | 0.8 to 10 |
| InI | 0.2 to 20 |

-continued

| fill component | micromoles of fill component |
|---|---|
| $CaI_2$ | 5 to 50 |
| $WO_3 + WO_2I_2$ | 0.1 to 40. |

20. A mercury-free high intensity discharge lamp comprising:

a discharge vessel formed of a ceramic material and defining an interior space, wherein an aspect ratio of the discharge vessel is satisfied by 1<ITL/ID<4.5 where ITL is the inner total length of the discharge vessel and IL) is the inner diameter of the discharge vessel;

at least one electrode extending into the discharge vessel; and a mercury-free ionizable fill disposed within the interior space and sealed within the vessel, wherein said fill is free of elemental mercury and mercury compounds, said fill including:

(a) an inert gas sealed within said vessel, said inert gas comprising at least about 95% Xe, said inert gas present at a cold fill pressure of from about 3 to about 15 bar; and (b) a halide component, said halide component comprising:

(i) sodium halide;

(ii) thallium halide and/or indium halide; and (iii) at least one rare earth halide, wherein the at least one rare earth halide comprises a combination of dysprosium halide, holmium halide, thulium halide, and cerium halide.

* * * * *